United States Patent [19]

Marietta, Jr. et al.

[11] 3,945,171

[45] Mar. 23, 1976

[54] FOOD PACKAGING APPARATUS

[75] Inventors: James W. Marietta, Jr., Alhambra; Maynard J. G. Tipper, Newport Beach, both of Calif.

[73] Assignee: James W. Marietta, Jr., Los Angeles, Calif.

[22] Filed: Jan. 20, 1975

[21] Appl. No.: 542,492

[52] U.S. Cl. ..... 53/79; 53/112 B; 53/258

[51] Int. Cl.[2] ..... B65B 31/06

[58] Field of Search ..... 53/79, 86, 112 B, 258

[56] References Cited

UNITED STATES PATENTS

| | | | |
|---|---|---|---|
| 3,624,982 | 12/1971 | Marietta | 53/79 |
| 3,827,210 | 8/1974 | Smalley et al. | 53/112 B X |

*Primary Examiner*—Travis S. McGehee

*Attorney, Agent, or Firm*—Georges A. Maxwell

[57] ABSTRACT

A vacuum packaging apparatus comprising an elongate tubular loading horn with front and rear ends, an elongate drive member shiftable axially forwardly to an actuated position within the horn, an item engaging pusher at the forward end of the member and shiftable rearwardly from a normal forward position forward of the member to an actuated position, the front of the pusher normally projecting forwardly from the horn when the member is in its actuated position and occurring within the horn when the member and pusher are in their actuated positions, an elongate vacuum nozzle within and extending longitudinally of the pusher when the pusher is in its normal position and projecting forwardly therefrom when the pusher is in its actuated position, an elongate supply of tubular packaging film shirred axially on and about the exterior of the horn with a lead portion extending forwardly from the horn and closed by a sealing means, an item conveyor extending forwardly from the horn to support items enveloped in the lead portion of the film urged forwardly from the horn by the pusher, and sealing and cutting means to seal the film at two longitudinally spaced locations between the item and the horn and to cut the film between the seals.

13 Claims, 16 Drawing Figures

FOOD PACKAGING APPARATUS

This invention has to do with food packaging apparatus and is more particularly concerned with improved apparatus for vacuum packaging of food stuffs in flexible plastic film.

In the food handling and/or processing arts and particularly in the meat and poultry processing art, it is common practice to envelope items of meat or poultry to be packaged in flexible plastic bags or the like. Further, it is common practice to evacuate as much air as is practical from within the plastic bags or wrappings and to hermetically seal the bags whereby as little oxygen, which might result in oxidation and spoilage of the food, is left within the bags.

The above noted packaging of food is commonly effected by providing simple plastic bags with open ends. The food is manually deposited in the bags. Elongate vacuum nozzles are then partially entered into the open ends of the bags and the portions of the bags of adjacent to the open ends thereof are manually gathered and held in substantial sealing engagement about the necks of the vacuum nozzles whereby air within the bags is drawn therefrom. When air is thus drawn from the bags, sealing devices are engaged about the gathered portions of the bags, between the food items and the nozzles therein. The excess bagging material, outward of the sealing devices is then cut or trimmed off and the food is packaged as desired.

In some instances, the plastic bagging material is such that when it is subjected to appropriate heat, it will shrink a substantial extent, for example, it will shrink about one-third in area. When such material is employed, the packaged food is immersed in hot water to shrink the bags and so that a neat and attractive package is provided.

The sealing devices employed to seal the plastic bags are commonly those devices which are likened to staples and consist of normally U-shaped malleable metal clips which are engaged and formed about the gathered plastic bagging material in pressure embracing and sealing engagement therewith, by a clip applicator or clipping device similar to a conventional stapler.

The above basic and common practice and means for vacuum packaging food items is effective, but is slow or time consuming and is therefore costly. The excess bagging material which is trimmed as above noted represents a substantial and costly waste of material.

Further, the above noted practice and means, in the interest of economy, requires that a multiplicity of different size bags be provided for the different and/or varying size of items to be packaged and that in the course of packaging the items, the bags must be manually handled and worked upon or with, one at a time.

In certain instances, where a more effective vacuum package of the character referred to above is sought to be provided, a vacuum chamber is provided and in which the above referred to and described packaging procedure is carried out or performed. When such a chamber is provided, a sub-atmospheric pressure is established about the exterior of the plastic bag, which pressure is transmitted to within the flexible bag and in and about the item to be packaged whereby the air within the bag is expanded and more rare than normal. When air is thus expanded and rarefied within the bag, it is then extracted therefrom by means of the elongated vacuum nozzle and the bag is clipped or sealed, as before.

In carrying out the foregoing procedure, it will be apparent that a more effective and near to perfect, air free, vacuum package is provided and that foods thus packaged can be expected to have a longer, safe, shelf life.

The vacuum chambers used in the last noted procedure are generally upwardly opening box-like units into which the unsealed bagged food items must be manua ly deposited. The chambers have manually operable covers or lids to close and seal the box-like units. The chambers next include small secondary vacuum chambers to communicate with the open ends of the bags and a special gate-like passages between the chambers through which the gathered open end portions of the bags must be manually arranged. Finally, the chambers are provided with clipping devices, adjacent the gate-like passages to apply the necessary clip or sealing devices when the air has been evacuated from the bags.

The principal advantage to be gained by use of the vacuum chamber in vacuum packaging is the elimination of trapped air pockets or bubbles between the bag and the food item which bubbles or pockets of air are commonly sought to be advanced toward the vacuum nozzle and relieved by manually applied, wiping pressure about the exterior of the bags, when vacuum chambers are not provided.

In practice, the utilization of vacuum chambers in vacuum packaging, as above noted, while resulting in a more effective vacuum package, requires the exercise of considerably more manual labor and effort and the expenditure of much more time, with the end result that the cost of such packaging is quite high and is only resorted to in special instances where an extended shelf life for the package product is required.

An object and feature of the present invention is to provide improved means for vacuum packaging food items and a means whereby the items can be and are effectively enveloped and hermetically sealed in sections of tubular plastic film stock advanced from one end of an elongate supply of tubular film stock.

It is another object and feature of the present invention to provide an apparatus of the general character referred to above including novel means for holding and dispensing an elongate supply of tubular film stock; novel means for advancing food items into engagement in dispensed sections of said film stock; novel means for relating a vacuum nozzle with the film stock and a related food item and novel means for clipping and sealing the end of dispensed film stock to seal the trailing end of the last to be dispensed section of film stock and to seal the leading end of the next to be dispensed section of film stock.

Yet another object and feature of this invention is to provide an apparatus of the character referred to including a conveyor means to movably support the packed items as they are packaged, and a novel vacuum chamber with portions shiftable relative to the conveyor means and releasably engageable with the vacuum nozzle whereby the air within the film and about the food item can be effectively evacuated when the film and product are within the chamber and subjected to sub-atmospheric pressure.

Still further, it is an object and feature of this invention to provide a chamber of the character referred to above in which the clipping and/or sealing means for the packaging film is arranged whereby the packaging film is effectively hermetically sealed when in the vacuum chamber.

It is a principal object and feature of the instant invention to provide an apparatus of the character referred to which eliminates the necessity to handle and individually manipulate plastic film bags and food items to effect the depositing of the items within such bags; to eliminate and/or greatly reduce the amount of plastic film stock commonly wasted when vacuum packaging food items in prepared plastic film bags and to provide novel conveyor and vacuum chamber means which eliminate the necessity of performing certain of those manual operations which are required to be performed in the case of vacuum packaging of food items within those vacuum chambers and with the vacuum packaging means and apparatus provided by the prior art.

The foregoing and other objects and features of our invention will be fully understood and will be apparent from the following detailed description of a typical preferred form and application of our invention, throughout which description reference is made to the accompanying drawings, in which.

Figures 1, 11, 12, 13:
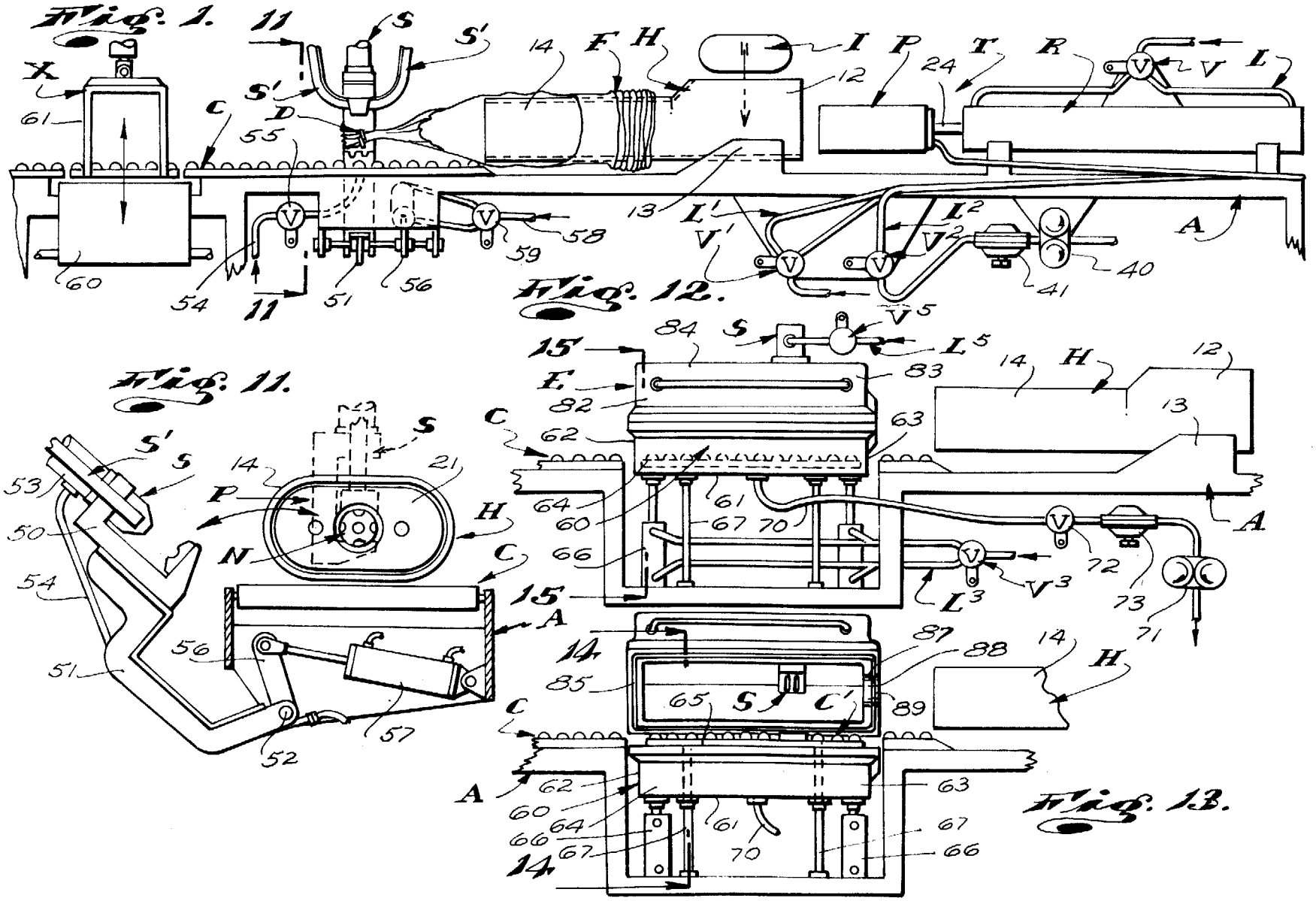
FIG. 1 is a longitudinal sectional view of the basic apparatus that we provide.
FIG. 11 is a view taken substantially as indicated by line 11—11 on FIG. 1.
FIG. 12 is a view similar to a portion of FIG. 1 and showing a vacuum chamber as provided by the present invention related thereto.
FIG. 13 is a view similar to FIG. 12 showing parts in another position.

Referring to FIG. 1 of the drawings, the apparatus provided by the present invention includes, basically, a loading horn H, a combination transporter and evacuator means T comprising a pusher P and vacuum nozzle N, a conveyor C and clipping or sealing means S.

In addition to the foregoing, the basic structure includes a supply of tubular plastic film stock F and supplies of clips or sealing devices S'.

The above noted basic components or parts of the apparatus are arranged longitudinally of and supported by a suitable, elongate, frame A having front and rear ends.

The loading horn H is an elongate unit having front and rear ends 10 and 11 and is supported in spaced relationship above the central portion of the frame A. The horn H is characterized by an upwardly and rearwardly opening funnel-like receiving end portion 12, at which it is supported, as at 13. The horn H is further characterized by an elongate forwardly opening tubular tube portion 14, communicating with and projecting freely forwardly from the funnel or receiving end portion 12.

The tube portion 14 can vary in cross-section to correspond as nearly as practical with the cross-section of the food items being handled thereby and is shown as being substantially ovoid in cross-section and as being greater in lateral extent than in vertical extent.

The interior of the horn H is smooth and unobstructed so that food items, such as the item I diagrammatically shown in the drawings, can be moved freely therethrough and so that the pusher P of the means T can be moved longitudinally therethrough, as will hereinafter be described.

The exterior of the tube section 14 of the horn H is smooth and free of obstructions and is adapted to cooperatively receive and support the tubular film stock F. The tubular film stock F is slightly greater in diametric extent than the tube portion 14, is engaged on and about the tube portion and is gathered and/or shirred longitudinally thereon and urged rearwardly whereby a substantial supply of film stock, that is, many lineal feet of said stock, can be engaged on and supported or carried by the horn. The forwardmost end of the film stock F extends forwardly from the gathered or shirred bulk of the stock to the forward end of the tube portion 14 and establishes the lead portion of stock required in operation of the apparatus here provided.

The conveyor C can vary in form and is shown as a simple, conventional elongate roller conveyor structure supported by the frame A and extending longitudinally forwardly from close proximity below the forward open end of the tube portion 14 of the horn H. The conveyor C is adapted to engage and/or receive the film F and items I advance forwardly through and from the horn H. It eliminates the need to manually receive and support said film and items and supports said film and items for subsequent cooperative relationship of the nozzle N and the clipping or sealing means S therewith, as will hereinafter be described.

It should be noted at this time that the body and portion of the tubular film stock F is normally drawn forward or is dispensed from the forward end of the tube portion 14 of the horn and is gathered and hermetically sealed at its forward terminal end by a single sealing device or clip D, as shown in FIGS. 1 through 5 of the drawings. The time of application of the clip D with respect to the sequence of operation of the apparatus will be fully described in the following description of the invention.

The combination transporter and evacuator means T, including the pusher P and nozzle N, is adapted to move and/or transport an item I deposited in the funnel portion 12 of the horn H, forwardly through and from the front end of the tube portion 14 of the horn H, into the lead portion of the film F and onto the conveyor C. The pusher preferably advances the item and said lead portion of the film forwardly beyond the front end of the tube section 14 of the horn into approximate cooperative relationship with the sealing or clipping means S and advances sufficient film stock F from the horn, to establish a new lead portion of such stock.

The pusher P comprises an elongate hollow body with a longitudinal side wall 20 corresponding in general cross-sectional configuration with the interior of the tube portion 14 of the horn H and is adapted to establish free running engagement in and through said tube portion. The pusher body has an open rear end and a flat, forwardly disposed item engaging front wall 21 with a central nozzle receiving opening 22. The pusher P next includes a cross-head 23, shiftably longitudinally in and through the rear portion of the pusher body and supported on the forward end of an elongate ram 24 of an elongate, double acting cylinder and ram or primary drive unit R of the means T. The unit R is fixed to and extending longitudinally of the rear portion of the frame A in rearward spaced relationship and in axial alignment with the horn H.

Finally, the pusher P includes one or more secondary drive units R′ in the form of double acting cylinder and ram units, within the pusher fixed to and extending between the front wall 22 and cross-head 24, substantially as shown.

In the case illustrated, we have shown two units R′ within the pusher P body, however, it is to be understood and will be readily seen and appreciated that in practice, a single unit R′ could be employed. Further, the unit or units R′ need not be arranged and related to the cross-head and the pusher body in the exact manner shown and need not occur within the pusher body. For example, the unit or units R′ could be arranged rearward of the cross-head and outside the pusher body without departing from the spirit of this invention.

Figure 3:
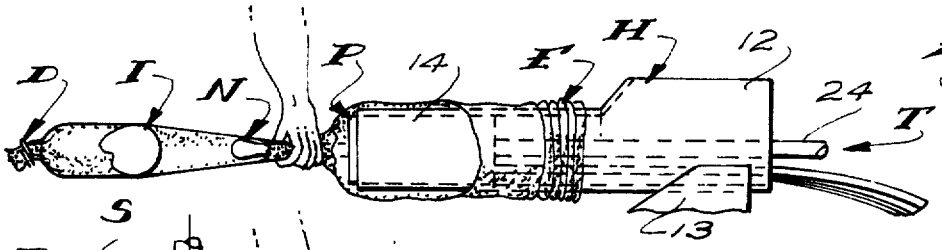
Figure 8:
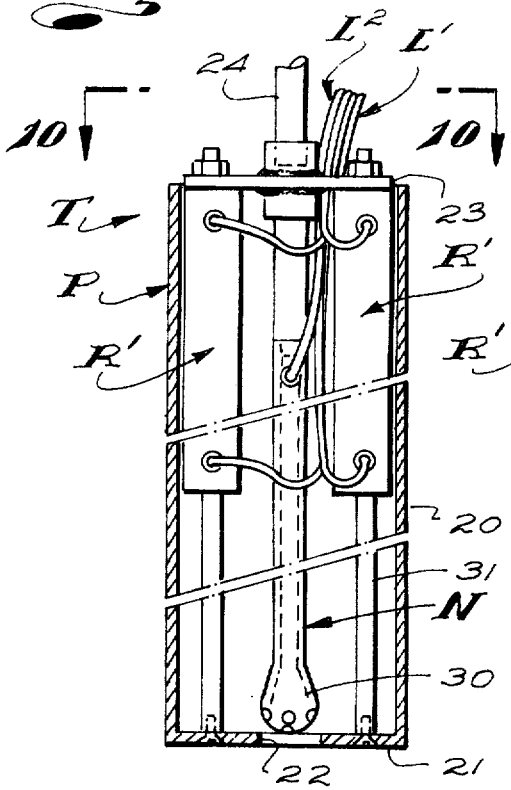
FIG. 8 is a sectional view taken as indicated by line 8—8 on FIG. 7.
Figure 10:
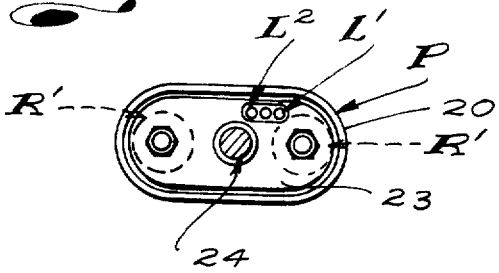
FIG. 10 is a view taken as indicated by line 10—10 on FIG. 8.

The length of the pusher body and the stroke of the primary and secondary drive units R and R′ is such that when the unit R is in its normal, unactuated retracted position, the pusher body occurs at or rearward of the rear of the funnel portion 12 of the loading horn H, as shown in FIG. 1 of the drawing. When the drive unit R is actuated and the ram 24 is shifted to its forward-most position, the pusher body is advanced forwardly into and through the horn H to a position where the front end of the pusher body is at or slightly forward of the front open end of the tube portion 14 of the horn, as shown in FIG. 3 of the drawings. The length of the pusher body and stroke of the secondary drive units R′ are such that when the drive units R′ are in their normal, unactuated, or extended positions, as shown in FIG. 8 of the drawings, the pusher body is in a forwardly extended position relative to the rod 24 of the unit R and the corss-head of the pusher P and occurs in those positions shown in FIGS. 1, 3 and 6 of the drawings with respect to the horn H, when the drive unit R is operated between its actuated and unactuated positions.

Figure 4:
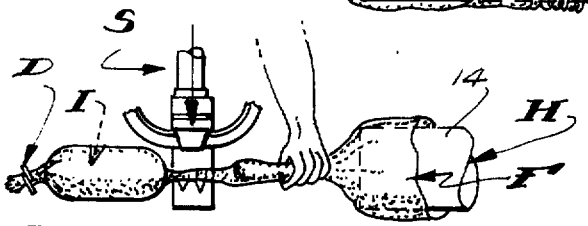
Figure 5:
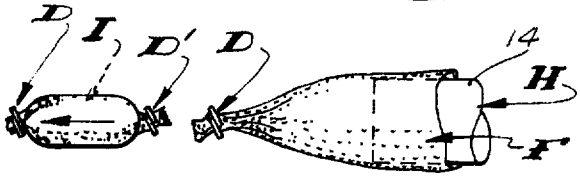
Figure 9:
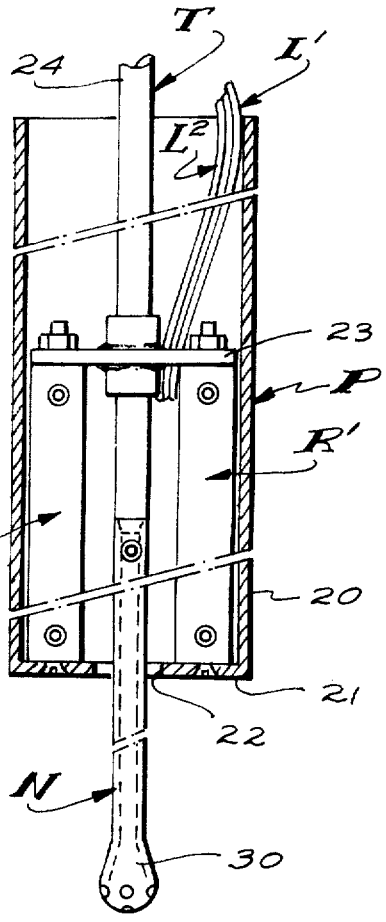
FIG. 9 is a view similar to FIG. 8 showing parts in another position.

When the secondary drive units R′ are actuated from their normal extended to their actuated or retracted positions as shown in FIG. 9 of the drawings, the pusher body is moved rearward relative to the ram 24 of the unit R and relative to the vacuum nozzle N as shown in FIGS. 3, 4 and 9 and as will hereinafter be described.

Figure 2:
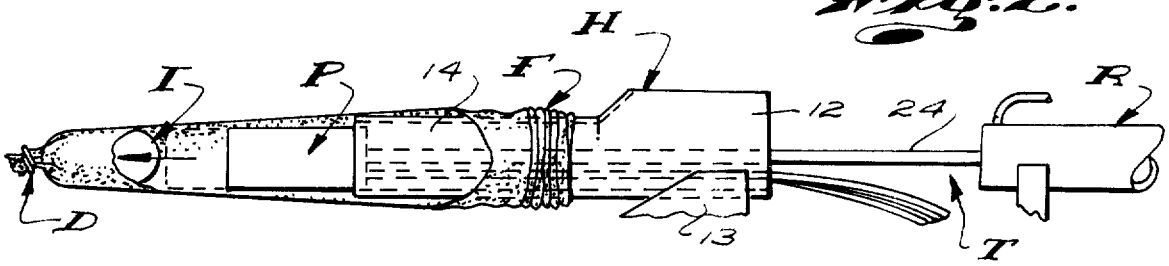
FIGS. 2, 3, 4 and 5 are views illustrating portions of the structure shown in FIG. 1 in different positions and illustrating certain progressive operations performed by said apparatus.

In light of the above, it will be apparent that the pusher P is operable between an unactuated position where it occurs rearward of the horn H, as shown in FIG. 1 of the drawings, a first actuated position where it projects forwardly from the front end of the horn, as shown in FIG. 2 of the drawing, and, a second actuated position where it occurs within the forward tube portion of the horn, with the front end in close proximity with the front end of the horn, as shown in FIG. 3 of the drawings.

With the apparatus thus far described it will be apparent that upon depositing an item I in the rear funnel portion 12 of the horn and upon actuating of the pusher to its first actuated position, the item is advanced through the horn and is urged forwardly therefrom into the lead portion of the film F (the forward end of which is clipped and sealed), advancing or drawing additional film from the horn, and depositing the enveloped item on the conveyor C, spaced forward from the horn, as clearly illustrated in FIG. 2 of the drawings. Subsequent to depositing the item I in the lead portion of the film and onto the conveyor forward of the horn, the pusher body is moved or retracted back into the horn, as shown in the drawings, leaving the enveloped item I on the conveyor in position to having additional work performed thereon.

In practice, the drive units R and R′ are preferably double acting pneymatic cylinder and ram units supplied with air for their operation from a suitable air supply, not shown, through suitable lines L and L′ and under control of manually operable valves V and V′. The lines L′ for the units R′ are preferably flexible lines and such that they permit free longitudinal shifting of the pusher relative to the horn. The lines L′ are shown extending from the rear end of the pusher body and as extending into and through the horn, when the pusher body is in its actuated positions.

While drive means other than the units R and R′ can be employed, the type or class of units illustrated and described are most desirable as they are of a type and class of drive means commonly employed in the food processing arts and find compatibility with health code requirements and the like.

The vacuum nozzle N is provided to evacuate air from within the lead portion of the film in which an item is enveloped or deposited and when the enveloped item is arranged and supported on the conveyor C, as above set forth. The nozzle N is an elongate tubular member normally arranged centrally in and extending longitudinally of the pusher body in axial alignment with the opening 22 in the front wall of the pusher body. The rear end of the nozzle N is suitably secured and mounted on the cross-head 23 to project forwardly therefrom and has an enlarged apertured head 30 at its forward end.

Figure 6:
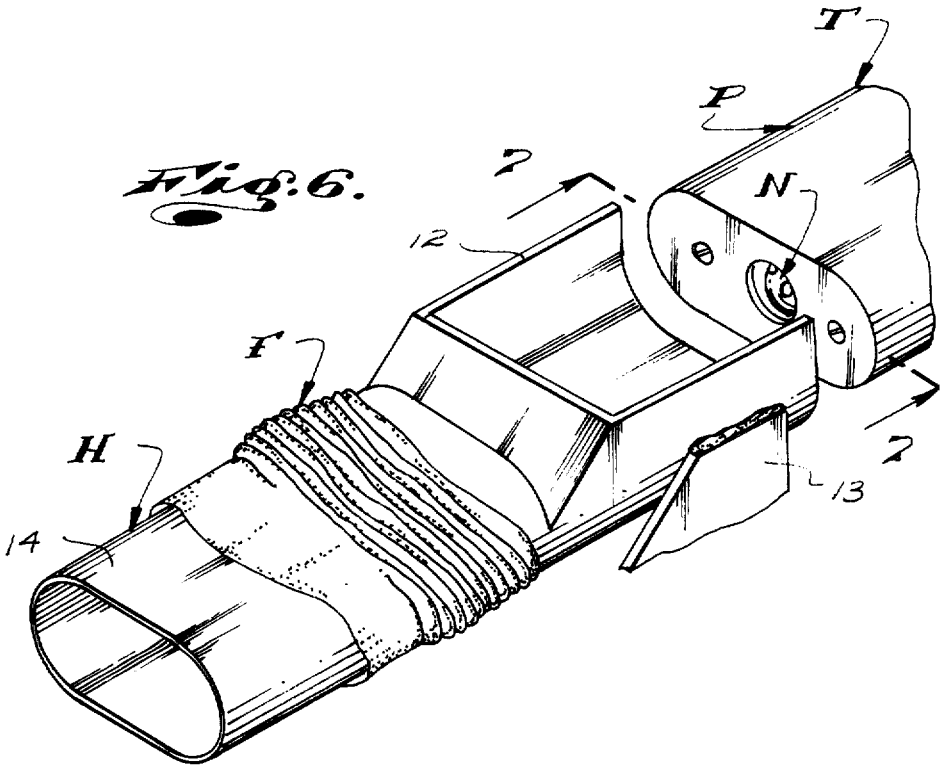
FIG. 6 is an enlarged isometric view of a portion of the apparatus.
Figure 7:
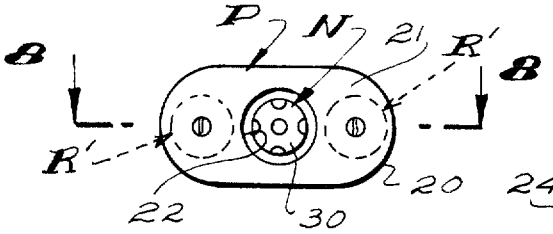
FIG. 7 is a view taken substantially as indicated by line 7—7 on FIG. 6.

The head 30 normally occurs immediately rearward or inward of the opening 22 in the front wall of the pusher body, when the drive units R′ are in their normal unactuated position, as shown in FIG. 6, 7 and 8 of the drawings.

The rear end portion of the nozzle is connected with a flexible vacuum line $L^2$ which extends rearwardly from the pusher P, parallel with the lines $L^1$. The rear end of the line $L^2$ is connected with a source of vacuum comprising, for example, a pump 40 pressure regulator 41 and a normally closed, manually operable vacuum control valve $V^2$.

The forward portion of the nozzle N rearward of the head 30 thereof establishes a manually engageable neck 31 about which the tubular film F can be gathered and held in sealing engagement by the grip of the operator hand O, as shown in FIGS. 3 and 4 of the drawings.

The nozzle N is such that when the pusher body is moved rearwardly to its second position, upon actuation of the units R′, it projects freely through the opening 22 forwardly from the front wall of the pusher body to occur within the advanced position of the tubular film F extending between the horn H and the item I and where it is exposed and convenient for normal engagement or gripping, as clearly illustrated in FIGS. 3, 4 and 9 of the drawings.

With the structure set forth above, it will be apparent that when the apparatus is operated to that position shown in FIG. 3 of the drawings, the film F and neck of the nozzle are manually gripped, as shown and the valve $V^2$ is open, air within the lead portion of the tubular film forward of the nozzle and about the item I therein is evacuated from within the film F and from about the item I. As the air is thus evacuated, the film is drawn inwardly and collapses about the neck of the nozzle to effectively seal therewith and the intermediate or free portion of film between the nozzle and the item is collapsed to establish a narrow, flattened and/or cord-like neck. At this stage, it might be necessary or desirable from time to time to shift or manipulate the work so that the flattened or corded film can be most advantageously clipped and sealed. When the package is formed to the above extent, the collapsed and/or corded intermediate portion is sealed or clipped by means of the clipping means S. At the same time, the noted intermediate portion of the film is sealed or clipped, rearward of the first applied seal D, as at D' and the film between the seals is severed, resulting in a complete packaged item and a anew lead portion on the film supply, to receive the next item to be packaged.

The clipping means S comprises two juxtapositioned, common or conventional clipping units or machines, there being a front unit and a rear unit to apply the longitudinally spaced front and rear clips D' and D. A film cutting means is provided between the units. Each unit has a vertically shiftable applicator head and clip supply S' comprising a chute connected with the head and in which a supply of U-shaped metal clips are arranged. The applicator heads of the units are adapted to be shifted toward a related foring mandrel across which the gathered and/or corded film is arranged and to thereby form clips in tight sealing engagement about the film. The cutting means can include a simple cutting blade fixed between the forming heads, to shift therewith and a cutting mandrel to be engaged by the blade and to effect cutting of the film, when and as the clips are applied.

In practice, and as shown, the foring heads and mandrels are carried by a substantially vertical laterally and longitudinally opening C shaped frame 50. The frame 50 is secured to the upper end of a substantially vertical arm 51 at one side of the conveyor, opposite or adjacent to the location or station on the conveyor between the forward end of the nozzle N and the item I when the apparatus is in the position shown in FIGS. 3 and 4 of the drawings. The lower end of the arm 51 is pivotally mounted below the conveyor on an axis parallel with the longitudinal axis of the conveyor, as at 52, and is so proportioned and shaped that the frame 50 occurs in lateral spaced relationship from the conveyor C when the upper end of the arm is pivotally swung laterally outward and away from the conveyor and occurs above the conveyor and in alignment with the central axis of the horn, pusher and nozzle when said arm is pivoted laterally inwardly toward the conveyor, as clearly illustrated in FIG. 11 of the drawings.

The sealing means can be manually operated or can, as shown, be pneumatically operated. As shown, the foring and cutting mandrels are secured to a lower leg of the C shaped frame 50 and the applicator heads and cutting blade are carried by a body on the lower end of the ram of a pneumatic cylinder and ram unit 53 carried by the other or upper leg of the frame 50. The body that carries the foring heads and blade is normally in vertical spaced relationship above the mandrels and is such that when the unit 53 is actuated, is shifted downwardly and moves the foring heads and cutting blace into working engagement with the mandrels to form the clips D and D' about gathered film extending through the frame, adjacent the mandrels and cuts the film between said clips. The unit 53 is supplied with air by a line 54, under control of a manually operable valve 55.

The arm 51 is shifted from a normal position where it supports the frame 50 laterally spaced from the conveyor, to an actuated position where the frame occurs above the conveyor and partially embraces or surrounds the aforementioned intermediate gathered portion of the film F, by an actuator means, which means can and is shown as comprising a lever arm 56 related to the lower end of the arm 51 and a double acting pneumatic cylinder and ram unit 57 between the lever arm 56 and the frame A of the apparatus. The unit 57 is supplied with air through an air supply line 58 and is under control of a manually operable valve 59.

It is to be understood that the means S can vary widely in form and construction without affecting the novelty or departing from the spirit of the present invention and that the means S illustrated and described above in a diagrammatic and general manner is intended to set forth one basic form in which said means might be advantageously provided.

With the means S, such as described above, it will be apparent that after an item is enveloped in the lead portion of the film F, and the air is evacuated therefrom, as shown in FIG. 4 of the drawings, the arm 51 is shifted from its normal position to its actuated position by operation of the valve 59, whereupon the means S is actuated to apply the longitudinally spaced clips D and D' to the intermediate portion of the film F, within the C shaped frame 50 and the film between the clips is cut, by manual operation of the valve 55.

The above noted clipping and cutting of the film completes the vacuum packaging of the item I and prepares the apparatus for recycling and similar packaging of a next to be packaged item.

In practice, and as shown in FIG. 1 of the drawings and where a heat-shrink film is employed, a suitable shrinking means X can be added in or to the conveyor C, at the forward end thereof. The means X can, for example, include a tank or basin 60 of hot water and a vertically shiftable conveyor section 61 onto which a packaged item can be advanced and which can be lowered into and thence elevated from the hot water in the basin, to effectively shrinking the film.

In that form of the invention shown in FIGS. 12 through 16 of the drawings, we have provided the apparatus with a vacuum chamber E. The chamber is arranged in and about the conveyor C forward of the horn H and at that station where the air within the film F about an enveloped item I is extracted by means of the nozzle N and where the sealing devices or clips are applied and said film is cut, as above described. The purpose of the vacuum chamber E as previously stated is to expand and rarefy the air about the film enveloped item so that the air within the film envelope is expanded and so that upon evacuating the air in the film envelope and from about the item, a greater amount of air can be effectively extracted and the presence of air bubbles or pockets within the finished packaged product is substantially eliminated.

The chamber E is shown as including an elongate upwardly opening, box-like, base section 60 with a horizontal bottom wall 61, front and rear vertical end walls 62 and 63 and vertical side walls 64. The upper edge portions of the side and end walls are formed to define a substantial flat, horizontal upwardly disposed sealing rim surface 65.

The section 60 is supported for vertical shifing by a pair of longitudinally spaced hydraulic cylinder and ram elevator units 66 mounted below and engaging or connected with the bottom wall 61 and is guided for vertical movement by a plurality of vertical columns 67 which are provided to support a section C′ of the conveyor C with which the chamber is related. The columns 67 are slidably engaged through sealing means 68 related to column receiving opening in the bottom wall 61 of the section 60 and support the conveyor section C′, within the confines of the chamber, in alignment with the remainder or other portions or sections of the conveyor C. In the case illustrated, the conveyor section C′ is a short section of conveyor means which is, in effect, removed from the primary conveyor and supported by frame 69 supported by the upper ends of the columns 67. We have shown four longitudinally and laterally spaced columns 67 to support the conveyor section C′ and to guide the base section 60 of the chamber.

The elevators units 66 are preferably double actying cylinder and ram units, are supplied with air for operation from a suitable air supply (not shown) through lines $L^3$, under control of a manually operable valve $V^3$.

The base section 60 is next provided with suitable vacuum means to evacuate air from within the chamber E, which means is shown as including a suction line 70 connected with the section 60 at the bottom wall thereof and extending to the intake of a suitable vacuum pump 71. The line 70 can be and is shown provided with suitable control means, such as a manually operable shut-off valve 72 and a pressure regulator 73.

Finally, the rearend wall 63 of the chamber's base section 60 is provided with an upwardly and longitudinally opening recess 74 in the upper rim portion thereof and which is provided with a suitable seal 75.

The conveyor section C′ is and at all times remains in alignment within the conveyor structure and the section 60 of the chamber is shiftable, vertically from a normal, lower or unactuated position where the rim portion thereof occurs below the top plane of the conveyor section C′ to an actuated, up position where the rim portion occurs above the top plane of the conveyor section C′ and said section C′ occurs down and wholly within the box-like chamber section 60, as clearly illustrated in FIGS. 12 through 16.

The chamber E next includes an elongate, upper, downwardly opening, box-like top section 80 with a top wall 81, front and rear vertical end walls 82 and 83 and vertical side walls 84. The lower edge portions of the end and side walls are formed to define a substantially flat downwardly disposed sealing rim surface 85. The surfaces 85 of section 80 correspond in plane configuration with and is shiftable into and out of opposing engagement with the surface 65 of the base section 60 of the chamber.

Figure 14:
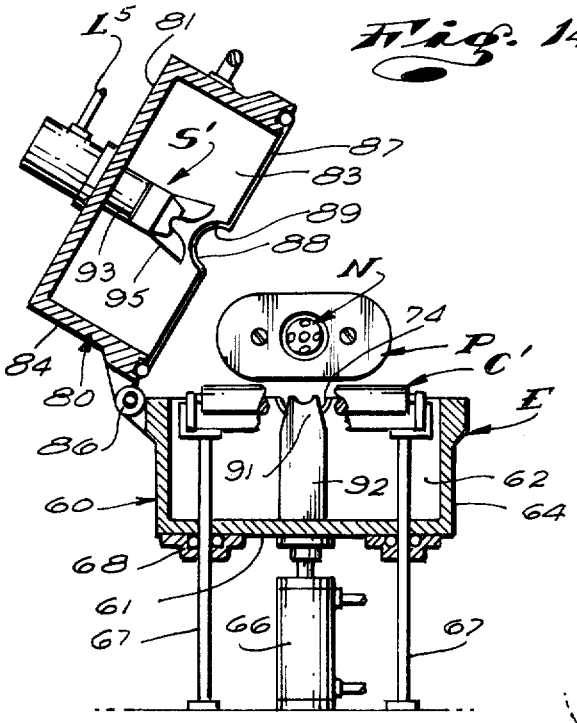
FIG. 14 is a view taken substantially as indicated by line 14—14 on FIG. 13.
Figure 15:
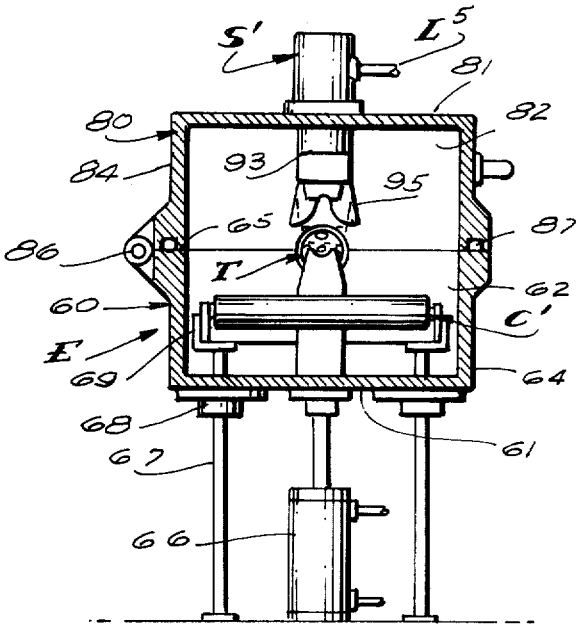
FIG. 15 is a view taken substantially as indicated by line 15—15 on FIG. 12.

The section 80 is hingedly connected with the section 60 by hinge means 86 on one side of the chamber and such that the section 80 can be manually pivoted upwardly and laterally outwardly from a closed position where the sections are opposed and the rim surfaces 65 and 85 are engaged, as shown in FIGS. 12 and 15; to an open position where the section 80 is moved laterally upwardly and laterally clear of the conveyor section C′ and to afford free access to the interior of the section 60, as shown in FIGS. 13 and 14 of the drawings.

The surface 65 of the section 60 or the surface 85 of section 80, or both, are provided with a suitable sealing means 87 to effect a vacuum seal between the section when they are in closed relationship with each other.

The rear wall 82 of the section 80 is provided with a downwardly and longitudinally opening recess 88 in the lower rim portion thereof and which is provided with a suitable seal 89. The recess 88 registers with and opposes the recess 74 in the lower section 60 of the chamber, when the sections are in their closed position and cooperates therewith to provide an axially opening, vacuum nozzle receiving throat T in the rearend of the chamber E.

Finally, the section 80 can be provided with a manually engageable handle to facilitate opening and closing the chamber.

The chamber is arranged and related to the other parts, portions and means of the apparatus that we provide and have described in the foregoing so that when the chamber is in its up and closed position, the throat T occurs in axial alignment with the horn H, pusher means P and vacuum nozzle N and is spaced forward of the horn a predetermined distance so that when the apparatus is in that position where the nozzle is in its forward most position and projects freely forward from the pusher P, as shown in FIGS. 3 and 4 of the drawings, the forward portion of the neck 31, at a portion thereof which occurs between the nozzle head 30 and that portion of the neck which is conveniently gripped in the operator's hand extends through the throat T and in such a manner that sealing engagement with and between the neck 31, the film F adjacent thereto and the sealing means 75–89 in the throat is established and maintained.

In carrying out the present invention, when the chamber E is provided, the form of sealing or clipping means S shown in FIGS. 1, 3 and 11 of the drawings cannot be advantageously employed and must be replaced by another form of sealing means S′ which can be arranged and operated within the chamber E. In accordance with the above, in FIGS. 12 through 16 of the drawings, the sealing means S′ is shown as including a dual clip foring mandrel 91 on the upper end of a post 92 fixed to and projecting upwardly from the bottom wall 61 of the base section 60 of the chamber to occur below and clear of the top plane of the conveyor section C′ when the chamber is in its lowered or down position and to project upwardly through the conveyor and in axial alignment with the throat T when the chamber is in its closed, up, position, as clearly illustrated in FIGS. 14, 15 and 16 of the drawings.

Figure 16:
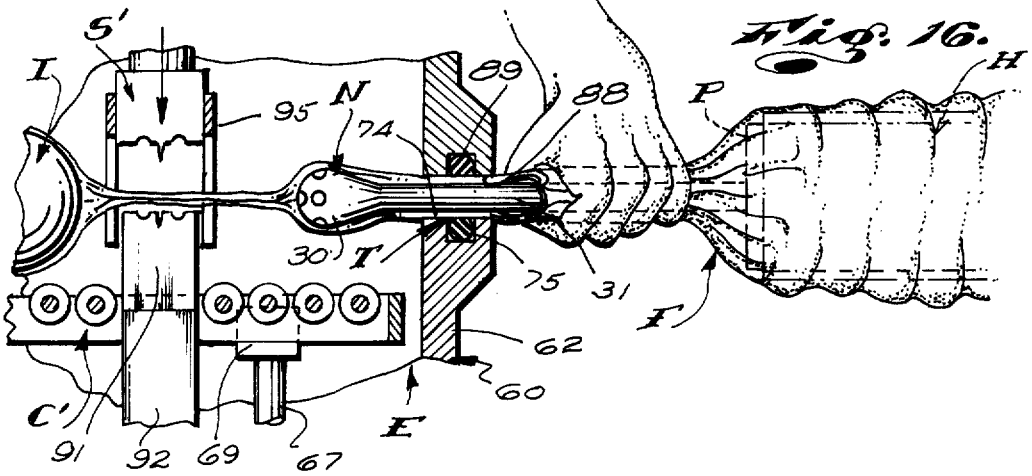
FIG. 16 is an enlarged sectional view illustrating parts of the apparatus shown in FIGS. 12 through 15 in one operative position relative to each other.

The means S′ next includes a pneumatically driven or operated vertically shiftable, dual clip applicator unit 93 mounted on the top wall 81 of the section 80 of the chamber and adapted to normally occur in predetermined vertical spaced relationship above and in alignment with the mandrel 91 when the chamber sections are in closed relationship with each other as shown in FIGS. 15 and 16 of the drawings. When the parts or portions of the means S′ are related in the above manner and the unit 93 is actuated, a collapsed chorded section of tubular film extending across the mandrel is effectively double clipped or sealed, at longitudinal spaced location and the film is out between the clips or sealed locations, in the same manner described above.

Since manual access to the interior of the chamber E to orient the film F relative to the clipping mandrel is not possible, as in the first embodiment of the invention, the means S′ is provided with suitable film gathering and orienting means 95, comprising simple longitudinally spaced substantially V-shaped film engaging guides carried by the unit 93. The means 95, or other similar means which have been provided by the prior art, effectively orient the film for clipping or sealing purposes.

The unit 93 is provided with air from a suitable supply through a line $L^5$ and is under control of a suitable manually operable valve $V^5$.

In operation, the apparatus, with the chamber E, is operated and/or used in the same manner as is the apparatus shown in FIGS. 1 through 11, up to but not including, that step in its operation and use when the sealing means S′ is to be actuated to seal and sever the tubular film F between the enveloped item I and nozzle N. Just before the above noted step is reached or performed, the chamber E is elevated and closed about the enveloped item I on the conveyor section C′ with the nozzle N and adjacent film engaged through and sealed in the throat T of the chamber. The air in the chamber E is then evacuated by operation of the vacuum means related thereto so as to expand and rarefy the air remaining in the chamber an in the film envelope about the item I. When the air is thus expanded, the expanded and rarefied air in the film envelope about the item is evacuated therefrom through the nozzle N. Thereafter, the means S′ is actuated to seal and cut the film, as before. Thereafter, the vacuum within the chamber is released, the chamber is opened and lowered, whereupon the finished packaged item is advanced forward along the conveyor means for further handling and/or treatment and the apparatus is ready for recycling and packaging of the next to be packaged item.

It is to be understood that in the foregoing, we have described, in a general manner only, one manner in which the apparatus with the chamber E can be utilized to package an item. In practice, by varying the minus pressures in the chamber and in or at the nozzle N and by varying the time such pressures are applied and/or the sequence in which they are applied, considerable control over the effectiveness and quality of the resulting package can be attained. However, since such controlled procedures and/or practices do not alter or affect the physical nature of the apparatus employed, but simply affect the manner in which one elects to utilize it, they do not affect novelty of one invention and further or detailed description thereof would only serve to unduly burden this disclosure. It will suffice to note that operation of the apparatus here provided is capable of being varied considerably for the attaining of certain desired end or results in the packages to be produced, without departing from the spirit of our invention.

Having described only typical and preferred forms and applications of our invention, we do not wish to be limited or restricted to the specific details herein set forth, but wish to reserve to ourselves any modifications and/or variations that may appear to those skilled in the art to which this invention pertains.

Having described our invention, we claim:

1. A vacuum packaging apparatus comprising an elongate, horizontal tubular horn with an open item receiving rear end and an open delivery front end, an elongate drive member in axial alignment with the horn and shiftable axially forwardly from a normal position where its front end is adjacent the rear end of the horn, to an actuated position within the horn, intermittently operable drive means to shift the member, an elongate pusher with an item engaging front end at the forward end of the member and shiftable from a normal forward position where it projects forwardly from the member to a rear actuated position relative to the member, the pusher being shiftable axially into, through and from the horn, intermittently operable pusher drive means to move the pusher between its normal and actuated position, said front end portion of the pusher occurring at the rear end of the horn when the member and pusher are in their normal position and projecting forwardly from the front end of the horn when the member is in its actuated position and said pusher is in its normal position and occurring within the forward portion of the horn when the member and pusher are in their actuated positions, an elongate vacuum nozzle with an elongate neck fixed relative to the drive member and having an apertured head at its front end and arranged within and extending longitudinally of the pusher when the pusher is in its normal position and projecting axially freely and forwardly from the pusher and the horn when the pusher and drive member are in their actuated positions, valve controlled air conducting means connected with and between the nozzle and air suction means, an elongate supply of tubular packaging film shirred axially on and about the exterior of the horn and having a lead portion extending axially forwardly from the horn and gathered and closed at its forward end by a sealing means, an elongate conveyor occurring below the front end of and extending forwardly from the front end of the horn to support and transport items enveloped in the lead portion of the film when items and film are urged forwardly from the horn by the pusher, and sealing and cutting means spaced forward of the front end of the nozzle when said nozzle projects freely forwardly from the pusher and horn, normally spaced radially outward from the axis of the horn and selectively shiftable into substantial axial alignment with the horn and operable to engage and seal the film at two longitudinally spaced locations between the item and the nozzle and to cut the film between the seals.

2. An apparatus as set forth in claim 1 wherein the drive means for the pusher comprises an elongate axially extending double acting cylinder and ram unit fixed to and extending between the member and the pusher, elongate air lines between the cylinder and an air supply and a manually operable valve means cooperatively related with said lines.

3. An apparatus as set forth in claim 1 wherein said seals comprise normally U-shaped malleable metal sealing clips formed in encircling pressure engagement about related gathered together portions of the film, said sealing means comprising a sealing clip applicator including a frame structure supporting a pair of axially spaced clip forming anvils carrying and foring heads normally spacef from, opposing and shifted toward the anvils manually controlled means to move the heads toward the anvils, manually controlled support means shiftably supporting the frame for radial movement into and out of axial alignment with the nozzle where said heads and anvils occur at opposite sides of film extracting forwardly from the horn and gathered radially inwardly forward of the nozzle, and cutting means supported between the heads and the foring anvils and to cut the film between the applied sealing clips upon movement of the heads toward the mandrels.

4. An apparatus as set forth in claim 3 wherein said cutting means comprises a cutting anvil between the foring anvils and a cutting blade between the advancing heads.

5. An apparatus as set forth in claim 1 including a vacuum chamber means to subject an item enveloped in film and supported by said conveyor to sub-atmospheric pressure when air is drawn from within the film about the item by means of said nozzle and when the film is sealed by said sealing means.

6. An apparatus as set forth in claim 5 wherein said chamber means comprises a lower upwardly opening box-like section normally engaged below the conveyor and shiftable vertically relative to and about that portion of the conveyor which supports an item where the sealing means is operated and about that area where the forward portion of the nozzle occurs when the nozzle projects freely forwardly from the horn and pusher, an upper box-like section pivotally connected with the lower section laterally outward from the conveyor and shiftable from a normal open position where it is out of interfering position above the conveyor and interfering position forward of the horn to a closed position where it occurs in downwardly opening opposing engagement with the lower section, a vacuum seal carried by and sealing between the sections, means in the end of the sections opposing the horn to accommodate and establish sealing engagement about the nozzle rearward of the head thereof, said sealing means carried by said sections to occur within the chamber defined thereby and manually operable valve control air evacuating means connected with one of said sections.

7. The apparatus set forth in claim 6 wherein the drive means for the pusher comprises an elongate axially extending double acting cylinder and ram unit fixed to and extending between the member and the pusher, elongate air lines between the cylinder and an air supply and a manually operable valve means cooperatively related with said lines.

8. The apparatus as set forth in claim 6 wherein said portion of the conveyor is supported on spaced vertical columns, said lower section has openings slidably receiving said columns and having sealing means to seal between the section and columns, said apparatus further including manually controllable elevator means to shift the lower section vertically upwardly and downwardly relative to the conveyor.

9. The apparatus set forth in claim 8 wherein the elevator means includes vertically extending cylinder and ram units fixed below and engaging the lower section, and air supply means for the units and including a manually operable control valve.

10. The apparatus set forth in claim 6 wherein said sealing means includes seals comprising manually U-shaped malleable metal sealing clips formed in encircling pressure engagement about related gathered together portions of the film, said sealing means comprising a clip applicator means including a pair of axially spaced clip foring anvils carried by the lower section of the chamber means to occur in the chamber and shiftable vertically with the lower section to occur below the item supporting plane of the portion of the conveyor within the chamber means when that section is in its lower position and to move upwardly through and occur above said plane of the conveyor when said section is moved upwardly, a pair of axially spaced clip carrying and foring heads carried by the top section of the chamber means and occurring in vertical spaced opposing relationship with the foring anvils when said top and bottom sections are in closed relationship, and manually actuated power driven means to move the heads toward and into clip-forming relationship with the anvils.

11. The apparatus set forth in claim 10 wherein the sealing means includes cutting means to cut film extending between an axially spaced related pair of clips formed thereabout by the foring anvils and heads and including a cutting anvil between the foring anvils and a cutting blade fixed relative to and between the heads and engageable with the cutting anvil when the heads are moved toward the anvils.

12. The apparatus set forth in claim 10 wherein the sealing means includes film gathering means shiftable with and relative to the heads and anvils to engage and gather film extending axially about the operating area of sealing means and arrange it in predetermined cooperative relationship with said sealing means.

13. The apparatus set forth in claim 12 wherein the sealing means includes cutting means to cut film extending between an axially spaced related pair of clips formed thereabout by the foring anvils and heads and including a cutting anvil between the foring anvils and a cutting blade fixed relative to and between the heads and engageable with the cutting anvil when the heads are moved toward the anvils.

* * * * *